US007438270B2

(12) United States Patent
Ligrano

(10) Patent No.: US 7,438,270 B2
(45) Date of Patent: Oct. 21, 2008

(54) HORIZONTAL MOUNTED HANGER HOLDER

(76) Inventor: Ronald Ligrano, 8643 Hayden Pl., Culver City, CA (US) 90232

( * ) Notice: Subject to any disclaimer, the term of this patent is extended or adjusted under 35 U.S.C. 154(b) by 114 days.

(21) Appl. No.: 11/525,408

(22) Filed: Sep. 22, 2006

(65) Prior Publication Data

US 2007/0069094 A1 Mar. 29, 2007

Related U.S. Application Data

(60) Provisional application No. 60/720,288, filed on Sep. 26, 2005.

(51) Int. Cl.
*A47F 5/00* (2006.01)

(52) U.S. Cl. ..... 248/301; 248/215; 248/304; 211/94.01

(58) Field of Classification Search ..... 248/339, 248/309.1, 301–303, 214, 215, 95, 304; 211/180, 211/119.004, 86.01, 88.01, 105.6, 106, 94.01, 211/94.03; 312/3, 4, 297; 206/285, 287, 206/289; 383/23, 33, 28
See application file for complete search history.

(56) References Cited

U.S. PATENT DOCUMENTS 931,853 A * 8/1909 Forehand ..... 383/9
1,078,729 A * 11/1913 Hill ..... 312/4
1,154,659 A * 9/1915 Schlachter ..... 312/5
1,981,510 A * 11/1934 Jones ..... 312/3
1,984,827 A * 12/1934 Derman ..... 312/4
2,325,806 A * 8/1943 Simmons ..... 206/287.1
3,536,287 A * 10/1970 Hyman ..... 248/301
4,111,309 A * 9/1978 Henry ..... 211/104
5,460,440 A * 10/1995 Moauro ..... 312/3
5,564,577 A * 10/1996 Knaggs ..... 211/86.01
5,876,009 A * 3/1999 Simoncioni, Jr. ..... 248/339

* cited by examiner

*Primary Examiner*—Korie H. Chan

(57) ABSTRACT

A horizontal mounted hanger holder is provided. Said mounted hanger holder includes a protective cover, an elongated member and a means for attaching therein, to a surface. Said elongated member within said protective cover, said elongated member, including a first and a second lip, said second lip contacting a second panel of a first and said second panel of said protective cover, mounted by a means, to said surface. Said horizontal mounted hanger holder provides for articles, including hangers, to be hung. Said hangers contact a channel of said elongated member, over said first lip, said hanger and said article are angled as to lie flat against a surface. Said protective cover, including a zipper, protects said articles from the outside environment.

15 Claims, 3 Drawing Sheets

HORIZONTAL MOUNTED HANGER HOLDER

PRIORITY

This application claims priority to a prior provisional application No. 60/720,288, filing date, Sep. 26, 2005.

BACKGROUND OF THE INVENTION

1) Field of the Invention

The invention relates to the storing and protecting of garments.

2) Discussion of the Related Art

Inventions exist that provide protective covering and support or hang articles to be stored within closets and other locations. The protective covering devices known, disclose various means for enclosing and or protecting articles. One such popular means has been a garment storage bag. The garment storage bag has a top and bottom wall, and side and rear walls formed from a flexible material such as plastic. The device is generally rectangular with a vertical zipper incorporated in the middle of the front panel. Garment bags are generally placed over garments and hung on a conventional hanger and rod. The vertical zipper along the front panel gives access to and complete closure of the garment bag.

The disadvantages of the garment storage bag are size limitation and access to the garment bag interior. Access can be difficult because access is not direct, but to the side, in relation to the user. Moreover, if more than one item is stored, retrieving a selected garment will be next to impossible without having to take the garments out of the closet and sort through them.

Vacuum bags and boxes relieve space in the closet but still require a significant amount of storage space. The stored items within Vacuum bags and boxes will need ironing after storage before they can be worn. Grouped hangers that drop vertically allowing more clothes to be hung, offer no protection to hanging garments. Grouped hangers cannot store a large quantity of garments and, as stated above, are difficult when it comes time to access the garments.

Current storage devices do not take advantage of difficult to use, unused storage space found in storage areas, specifically, storage space located in the rear of closets and other areas that are narrow and difficult to store hanging garments. Current storage devices do not provide the capability to store a large amount of items, protect those items and allow a user access when a user seeks an item, without any undue burden.

BRIEF DESCRIPTION OF THE DRAWINGS

The invention is described by way of example with reference to the accompanying drawings wherein.

DETAILED DESCRIPTION OF THE INVENTION

Figure 1:
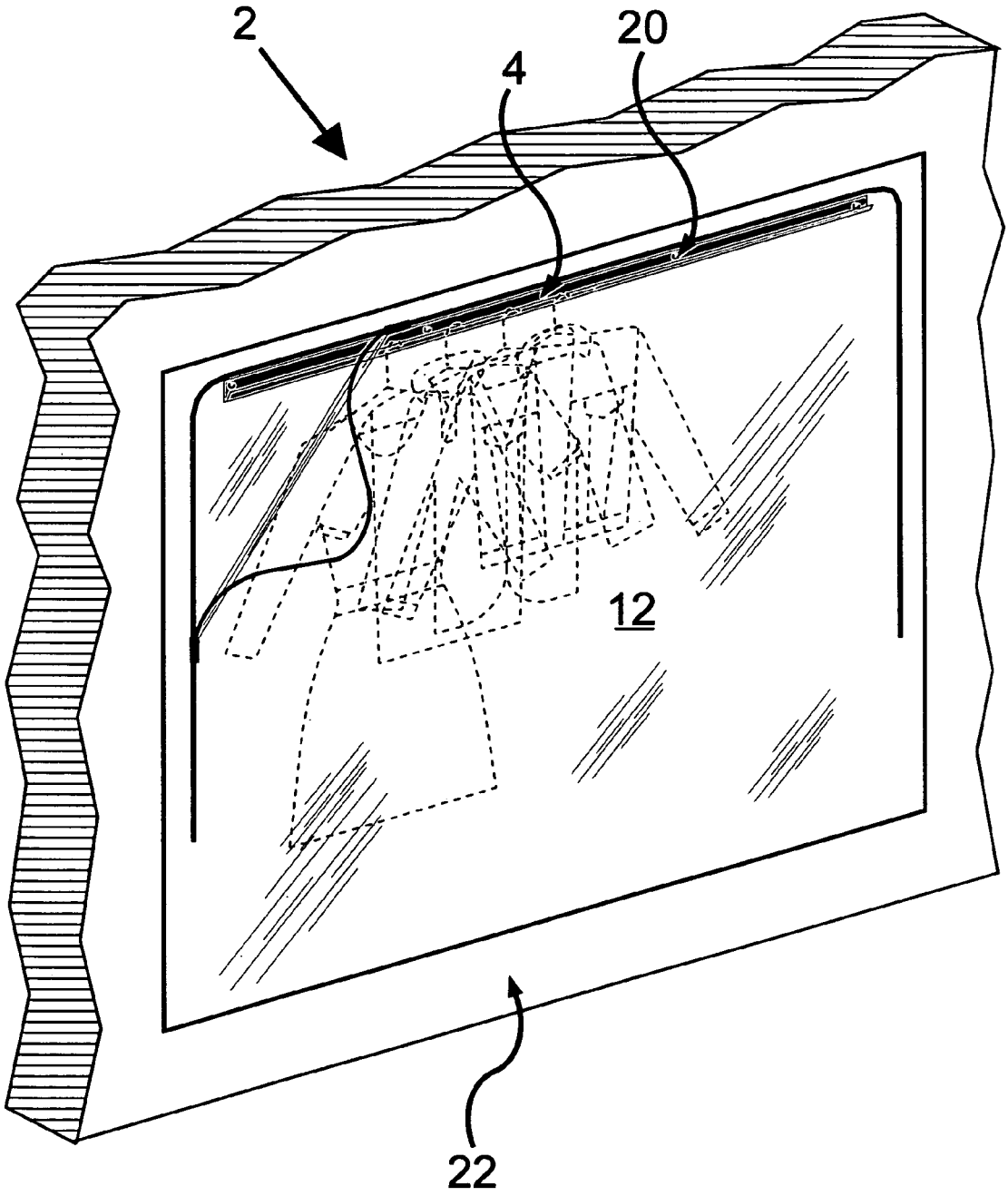
FIG. 1 is a perspective view of a horizontal mounted hanger holder.

FIG. 1 of the accompanying drawings illustrates a mounted hanger holder 2. The mounted hanger holder 2 includes, an at least one elongated member 4, a protective cover 12 and a means for attaching 20 to a surface 22.

Figure 2:
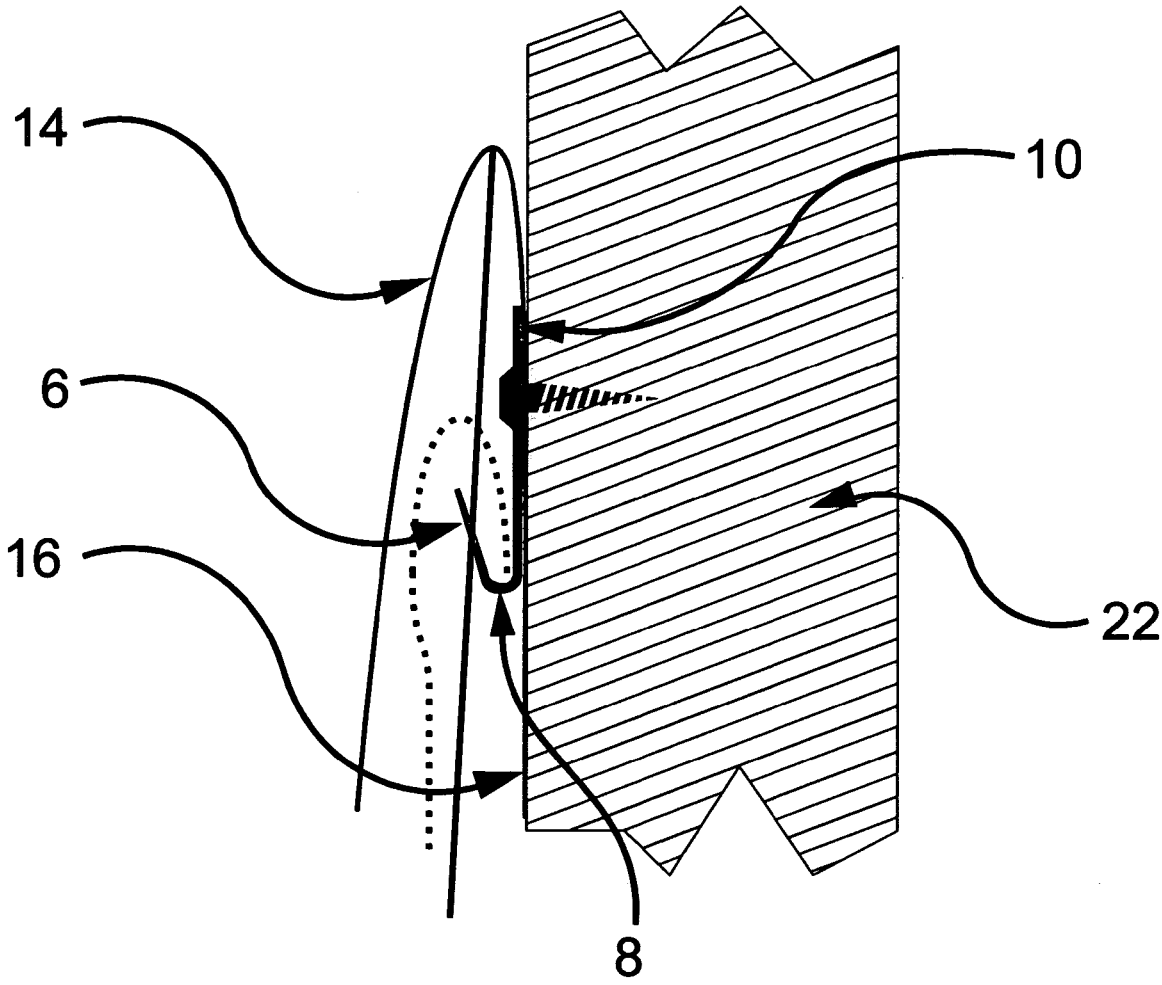
FIG. 2 is a side view of a protective cover, an elongated member and a means for attaching therein, to a surface.
Figure 3:
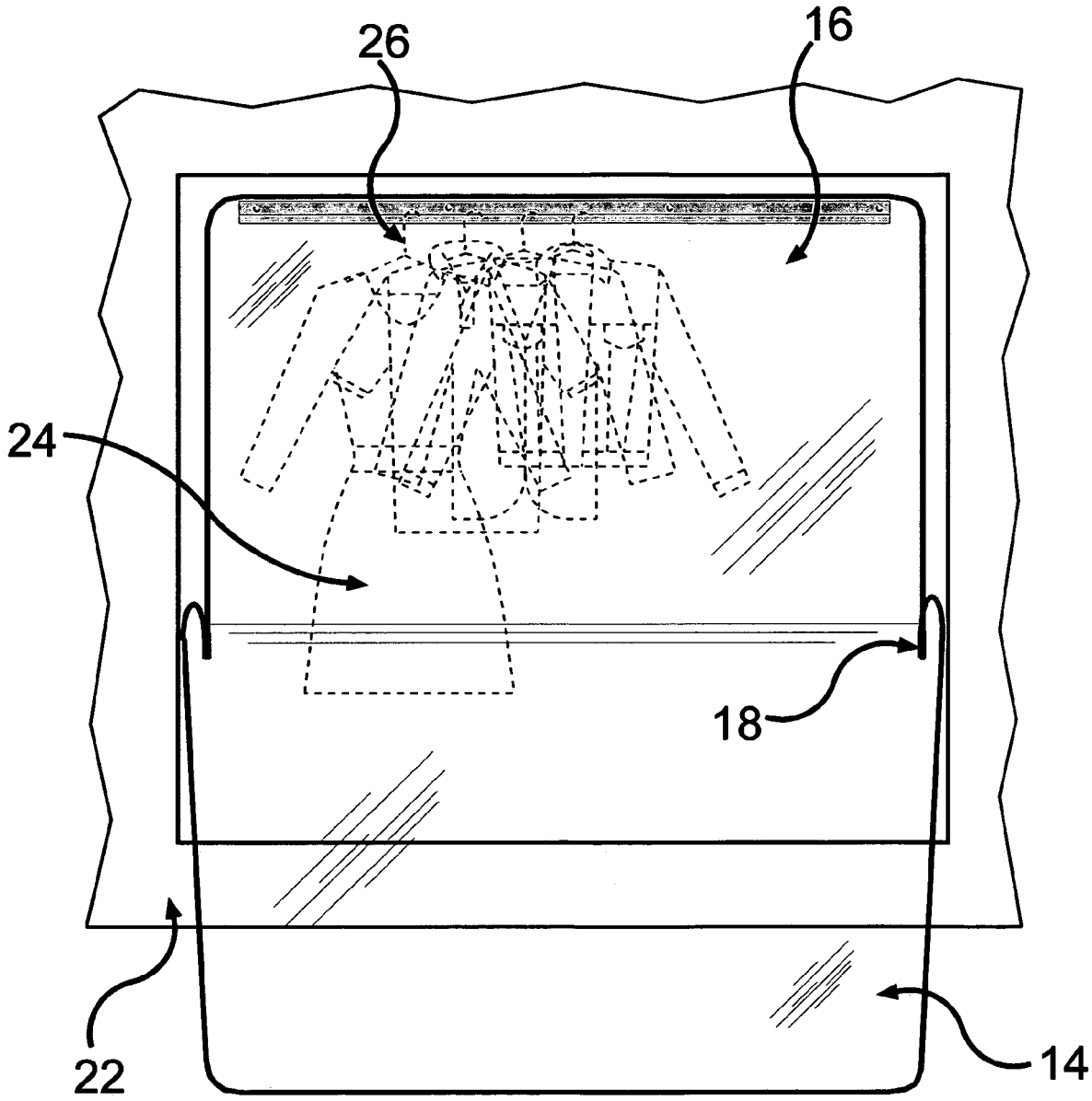
FIG. 3 is a front perspective of said horizontal mounted hanger holder, with said protective cover opened, including a zipper, a plurality of articles, including a plurality of hangers.

FIG. 2 illustrates the components of said at least one elongated member 4 in more detail, including a first lip 6, a channel 8 and a second lip 10. In an embodiment, said first and second lip, 6 and 10 respectively, are substantially the same height. FIGS. 2 and 3 illustrate the components of said protective cover 12. FIG. 2 illustrates a first panel 14, a second panel 16, as illustrated in FIG. 3, a zipper 18. In another embodiment said zipper is a plurality, providing access to a large number of stored articles. In another embodiment, said protective cover 12 is transparent allowing a user to visually inspect the clothing in determining selection.

FIG. 2 illustrates said means for mounting 20 said at least one elongated member, contacting said second panel 16, to a surface 22. Said means for mounting comprise a plurality of screws. However, said means can comprise Velcro straps, fasteners, hooks, clips, wire and other types of conventional attachment hardware that can provide the strength and stability to counter the weight of hanging articles.

FIG. 3 illustrates a plurality of articles 24 on hangers 26. Said zipper 18, is unzipped, exposing said second panel 16 and said at least one elongated member 4. Said plurality of articles 24 on hangers 26, contact said channel 8 of said at least one elongated member 4.

In use, said mounted hanger holder 2 maximizes storage space by arranging articles hung by hangers in an angled and flat fashion. Said at least one elongated member 4, including said first lip 6, said channel 8 and said second lip 10, is inserted into said protective cover 12, including said first and second panel 14 and 16, respectively. Said second lip 10 of said at least one elongated member 4, contacting said second panel 16, is mounted to said surface 22. Said means for mounting comprise a plurality of screws. However, said means can comprise Velcro straps, fasteners and other types of conventional attachment hardware that can provide the strength and stability to counter the weight of hanging articles.

Said plurality of articles 24 on hangers 26, contact said channel 8 of said at least one elongated member 4. Said first and second lip, 6 and 10 respectively, prevent said hanger 26 from unhooking and, including said channel 8, angle said hanger 26, resulting in said plurality of articles 24 to lie flat against said surface 26. Said zipper 18, is zipped, connecting said first and second panel 14 and 16, respectively, protecting said plurality of articles 24.

Storage devices seek to provide a spaced starved area, efficiency. Said horizontal mounted hanger holder takes advantage of usable, mountable space, which is otherwise not used because of a lack of art or deficiencies in the available art. An advantage of said horizontal mounted hanger holder is its ability to store a large number of articles, including hangers, in a manner that places those articles in the most efficient angle against a surface, in a storage space that would otherwise, not be usable.

Said horizontal mounted hanger holder also provides access to those articles in a manner that improves over the prior art, by using a protective cover, that is transparent and containing an open zipped flap, so there is no pulling or tugging on selected articles to be pulled out, in a front view manner, there is no adjusting, manipulating or undue burden when selecting items. Said protective cover also aims to protect said articles from the environment, including dirt, dust, moths, bugs and webs.

While certain exemplary embodiments have been described and shown in the accompanying drawings, it is to understood that such embodiments are merely illustrative and not restrictive of the current invention, and that this invention is not restricted to the specific constructions and arrangements show and described since modification may occur to those ordinarily skilled in the art.

What is claimed:

1. A mounted hanger holder, comprising:

a protective cover including, a first panel, a second panel, a zipper;

at least one elongated member, including a channel defined by a first lip extending from a second lip, said at least one elongated member disposed within said protective cover wherein said first lip pressing said second panel against a mounting surface; and said second lip providing a supporting edge for hangers;

and a means for mounting said elongated member and contacting said second panel to said mounting surface.

2. The mounted hanger holder of claim 1, wherein said cover is transparent.

3. The mounted hanger holder of claim 1, wherein there is a plurality of said zipper.

4. The mounted hanger holder of claim 1, wherein said first and second lip are substantially the same height.

5. The mounted hanger holder of claim 2, wherein there is a plurality of said zipper.

6. The mounted hanger holder of claim 3, wherein said first and second lip are substantially the same height.

7. The mounted hanger holder of claim 4, wherein said cover is transparent.

8. A mounted hanger holder, comprising:

a protective cover, transparent, including, a first panel, a second panel, a plurality of zippers;

at least one elongated member, including a channel defined by a first lip extending from a second lip, said first and second lip at substantially the same height, said at least one elongated member disposed within said protective cover wherein said first lip pressing said second panel against a mounting surface; and said second lip providing a supporting edge for hangers;

and a means for mounting said elongated member and contacting said second panel to said mounting surface.

9. A method for hanging articles, comprising:

inserting a at least one elongated member, including a channel defined by a first lip extending from a second lip, into a protective, said protective cover including a first panel, a second panel and a zipper, wherein said first lip pressing said second panel against a mounting surface; and said second lip providing a supporting edge for hangers;

contacting said first lip of said at least one elongated member to said second panel;

mounting said first lip, contacting said second panel, using a means for mounting to a surface;

and hanging a least one article, including a hanger, on said second lip of said at least one elongated member, said hanger contacting said channel, said article, angled, flat against said surface.

10. The method of claim 9, wherein said cover is transparent.

11. The method of claim 9, wherein there is a plurality of said zipper.

12. The method of claim 9, wherein said first and second lip are substantially the same height.

13. The method of claim 10, wherein there is a plurality of said zipper.

14. The method of claim 11, wherein said first and second lip are substantially the same height.

15. The method of claim 12, wherein said cover is transparent.

* * * * *